US007528336B2

(12) United States Patent
Hashimoto et al.

(10) Patent No.: US 7,528,336 B2
(45) Date of Patent: May 5, 2009

(54) GAS CIRCUIT-BREAKER

(75) Inventors: Hiroaki Hashimoto, Kasumigaura (JP); Hideo Kawamoto, Hitachi (JP); Kenichi Okubo, Hitachi (JP)

(73) Assignee: Japan AE Power Systems Corporation, Tokyo (JP)

( * ) Notice: Subject to any disclaimer, the term of this patent is extended or adjusted under 35 U.S.C. 154(b) by 206 days.

(21) Appl. No.: 11/525,838

(22) Filed: Sep. 25, 2006

(65) Prior Publication Data

US 2007/0068903 A1 Mar. 29, 2007

(30) Foreign Application Priority Data

Sep. 26, 2005 (JP) ..... 2005-277036

(51) Int. Cl.
*H01H 3/32* (2006.01)

(52) U.S. Cl. ..... 200/400; 218/14; 218/154

(58) Field of Classification Search ..... 200/400, 200/401, 500, 501, 17 R; 218/7, 14, 78, 218/153, 154, 140
See application file for complete search history.

(56) References Cited

U.S. PATENT DOCUMENTS 4,162,385 A * 7/1979 Bould et al. ..... 200/400
4,888,458 A * 12/1989 Suzuyama et al. ..... 200/400
5,628,394 A * 5/1997 Benke et al. ..... 200/400
6,762,387 B2 * 7/2004 Kawamoto et al. ..... 218/84
2004/0179318 A1 * 9/2004 Hashimoto et al. ..... 361/115

FOREIGN PATENT DOCUMENTS

JP 04-071131 3/1992
JP 2001-266719 9/2001

* cited by examiner

*Primary Examiner*—Elvin G Enad
*Assistant Examiner*—Marina Fishman
(74) *Attorney, Agent, or Firm*—Mattingly & Malur, P.C.

(57) ABSTRACT

In an interrupter of a gas circuit breaker that uses springs as a driving source, a contact having a fixed contact and movable contact is opened and closed so as to turn on and off electric power. An operation unit generates driving force for driving the movable contact. A link mechanism interconnects the operation unit and interrupter. The link mechanism has a first lever linked to the operation unit, a second lever linked to the movable contact, and a rotational shaft to which the two levers fit. The operation angle of the first lever with respect to a direction parallel to the motion direction of the movable contact differs depending on whether the contact is open or closed. The gas circuit breaker operates at high speed without the energy of the driving source being increased.

20 Claims, 8 Drawing Sheets

GAS CIRCUIT-BREAKER

CLAIM OF PRIORITY

The present application claims priority from Japanese application serial no. 2005-277036, filed on Sep. 26, 2005, the content of which is hereby incorporated by reference into this application.

FIELD OF THE INVENTION

The present invention relates to a gas circuit breaker and, more particularly, to a gas circuit that is suitable for use at high voltages in a substation, a switching station, or the like.

BACKGROUND OF THE INVENTION

An exemplary spring operating mechanism used in a gas circuit breaker (abbreviated below as a gas circuit breaker sometimes) that is provided in a substation or switching station and used at voltages of 300 kV or lower is described in Japanese Patent Laid-Open No. 2001-266719. The gas circuit breaker described in this document uses helical springs as a driving source for opening and closing. Another example of a gas circuit breaker is described in Japanese Patent Laid-Open No. Hei 04 (1992)-71131. In the gas circuit breaker described in this document, to make an operation unit compact and achieve high-speed operation, a swinging lever linked to an operating apparatus is provided on a plane parallel to the operation shaft of a movable electrode part. An end of the swinging lever is linked to a driving rod for driving the movable electrode part through at least one floating lever. When a rotational operation angle of the swinging lever is divided into two parts by a line that passes through the rotational center of the swinging lever and is orthogonal to the operation shaft of the movable electrode part, the following relation holds:

$$\theta_1 \geqq 1.5\theta_2$$

where $\theta_1$ is a rotational operation angle on the movable electrode part side and $\theta_2$ is the remaining rotational operation angle.

SUMMARY OF THE INVENTION

To operate a spring operating gas circuit breaker as described in Patent Document 1 at high speed, the driving force of an operating mechanism needs to be increased. When the driving force is increased, however, the volume of the spring, which is the driving source, becomes too large, enlarging the operating apparatus. Particularly, in the case of the circuit breaker described in Patent Document 1, in which helical springs are used as a driving source, about one-third of the mass of each helical spring becomes an inertial load. The entire inertial load acts on the operation shaft of the spring, so the energy required to move the spring itself is increased, making it difficult for the gas circuit breaker to operate at high speed. If the spring force is increased, the mass of the movable part needs to be increased to maintain its strength.

With the gas circuit breaker described in Patent Document 2, an insulative gas is sealed by a sliding part that moves linearly, so the floating lever can be disposed only in a limited manner so that a bending force is not applied to a seal rod in order to maintain the hermeticity. If the circuit breaker is operated at high speed, the amount of sealing by a sealing member of the sliding part which moves linearly is increased, lowering the durability of the sealing member.

The present invention addresses the above problems in the prior art with the object of operating a gas circuit breaker that uses springs as a driving source at high speed without increasing the energy of the driving source. Another object of the present invention is to operate a gas circuit breaker at high speed and increase the reliability.

To achieve the above objects, the present invention, which is a gas circuit breaker, has an interrupter for turning on and off electric power by opening and closing a contact having a fixed contact and a movable contact, an operation unit which generates a driving force for driving the movable contact, and a link mechanism for interconnecting the operation unit and the interrupter; the link mechanism has a first lever linked to an operation unit side, a second lever linked to a movable contact side, and a rotational shaft for attaching the two levers; an operation angle of the first lever with respect to a direction parallel to the motion direction of the movable contact differs depending on whether the contact is open or closed.

The link mechanism has a link for interconnecting the operation unit and the first lever; the operation unit has a third lever connected to an end of the link and a main shaft for supporting the third lever; an operation angle of the third lever with respect to a direction parallel to the motion direction of the movable contact preferably differs depending on whether the contact is open or closed, and it is desirable that rotational operation angles of the first lever and second lever be larger than a rotational operation angle of the third lever.

An insulator for interconnecting the second lever and the movable contact is provided; an operation angle of the second lever with respect to a direction perpendicular to the motion direction of the movable contact is preferably almost the same between when the contact is open and when the contact is closed; when the operation angle of the first lever with respect to a direction parallel to the motion direction of the movable contact is compared between when the contact is open and when the contact is closed, the ratio of the operation angle with the contact open to the operation angle with the contact closed is further preferably about 3:1.

Preferably, rectangular holes or spline grooves are formed at portions on the rotational shaft at which the first lever and the second lever are attached, a rectangular hole or a spline groove is formed at a portion on the main shaft at which the third lever is attached, and angular shafts or spline shafts are formed on the rotational shaft and the main shaft, so that the first lever, the second lever, and the third lever are detachably mounted. The first lever and the second lever are preferably disposed so that the operation planes of the first lever and second lever are parallel to each other; there are preferably provided a sealing means for sealing the rotational shaft, to which the first lever and the second lever are attached, between attaching parts for the first lever and second lever as well as an accommodating member for holding the sealing means and accommodating the second lever; the first lever preferably operates in the ambient atmosphere and the second lever operates in an insulative gas. The operation unit should have helical compression springs as a driving source.

In the inventive gas circuit breaker using springs as a driving source, the operation stroke positions of a first link are asymmetrical with respect to a direction parallel to the motion direction of a movable contact, enabling the circuit breaker to be operated at high speed without having to increase the energy of the driving source. Furthermore, only a rotational shaft to which a lever linked to an operation unit and another lever linked to an interrupter are attached is sealed, so the gas circuit breaker can operate at high speed with improved reliability.

DESCRIPTION OF THE PREFERRED EMBODIMENTS

Figure 1:
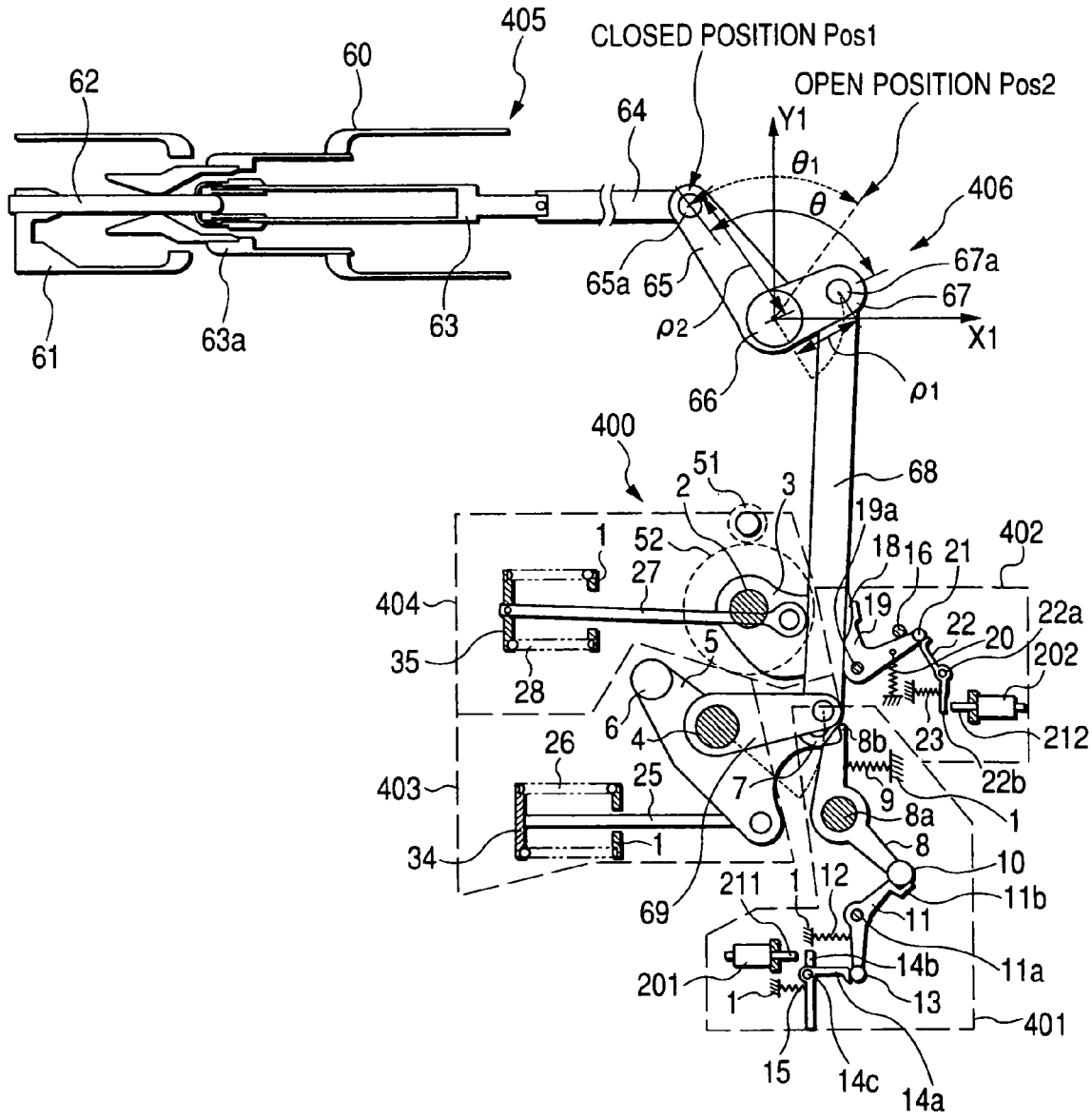
FIG. 1 schematically shows an embodiment of a gas circuit breaker for electric power according to the present invention.

An embodiment of the present invention will be described below with reference to FIGS. 1 to 9. FIG. 5 is a front view of a gas circuit breaker 100. The gas circuit breaker 100 has a cylindrical ground container 103 and a base 105 on which the ground container is mounted. The cylindrical ground container 103 includes an insulative gas such as, for example, $SF_6$ gas (sulfur hexafluoride gas) under a prescribed pressure. Bushings 101 and 102 extend upward at angles from the midpoint in the axial direction of the cylindrical ground container 103. Conductors connected to electric wires in a substation or switching station and forming electric circuits are accommodated in the bushings 101 and 102. An operation box 104 for accommodating an operation unit of the gas circuit breaker 100 is attached to a side of the base 105.

In the gas circuit breaker 100 structured as described above, electric power is supplied from a system (not shown) to the bushing 102 on the upstream side when, for example, power is turned on. The power is led from the bushing 102 to the bushing 101 on the downstream side through a contact in the ground container 103. The power is then returned to the system. If the system has an accident caused by, for example, a lightning strike, the operation unit in the operation box 104 is driven to open the contact in the ground container 103, shutting down the electric power to the downstream side. It should be appreciated that although the ground container 103 is disposed horizontally in this embodiment, it may be disposed vertically. It should also be understood that an independent gas circuit breaker in which bushings are directly attached to the ground container 103 will be described in this embodiment, but a gas circuit breaker may be built into a gas insulated switchgear. A gas circuit breaker that uses $SF_6$ gas is taken as an example in the description that follows, but the present invention can also be applied to other types of switchgears such as a vacuum circuit breaker.

Figure 2:
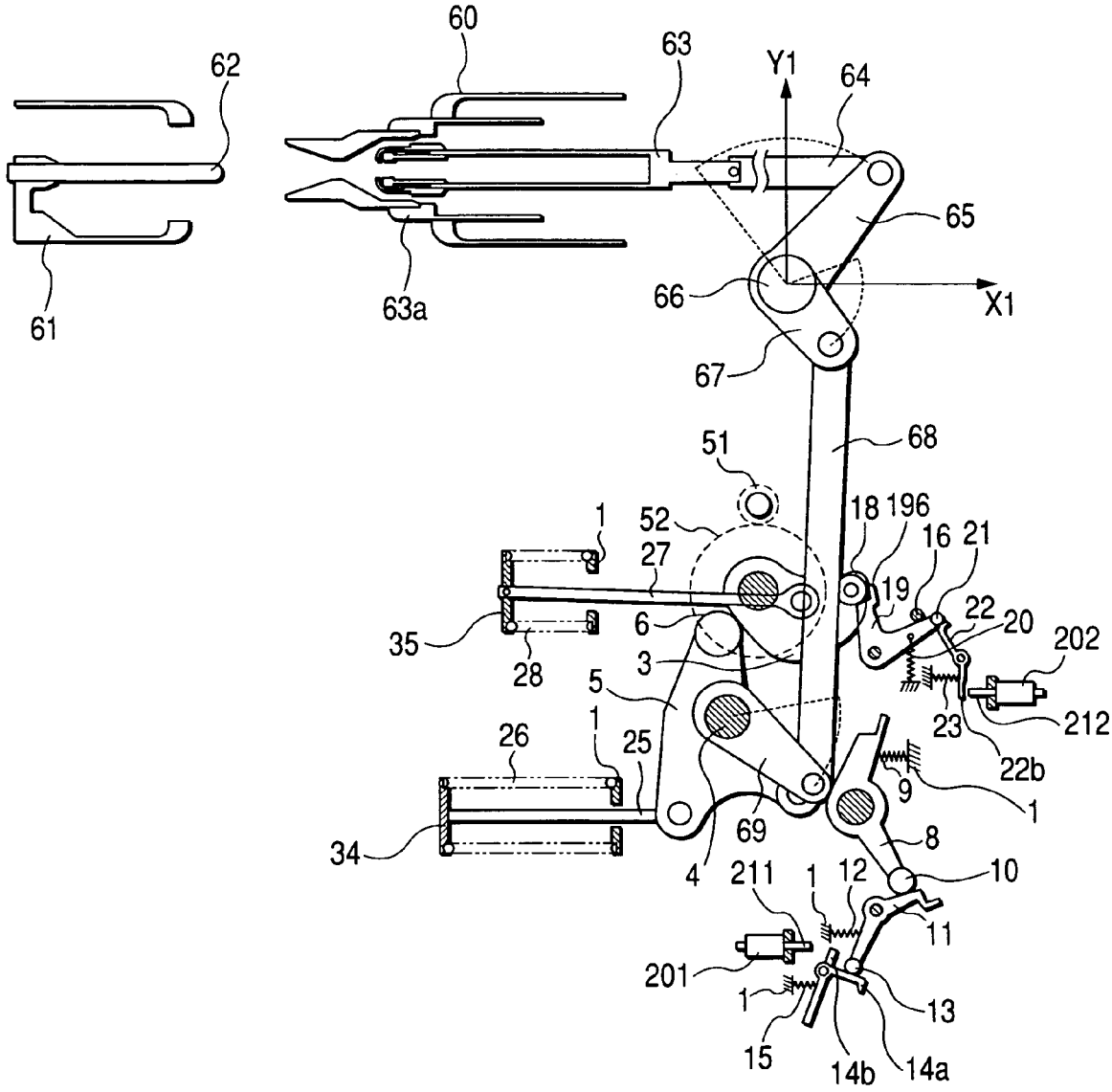
FIG. 2 illustrates an operation of the gas circuit breaker shown in FIG. 1.
Figure 3:
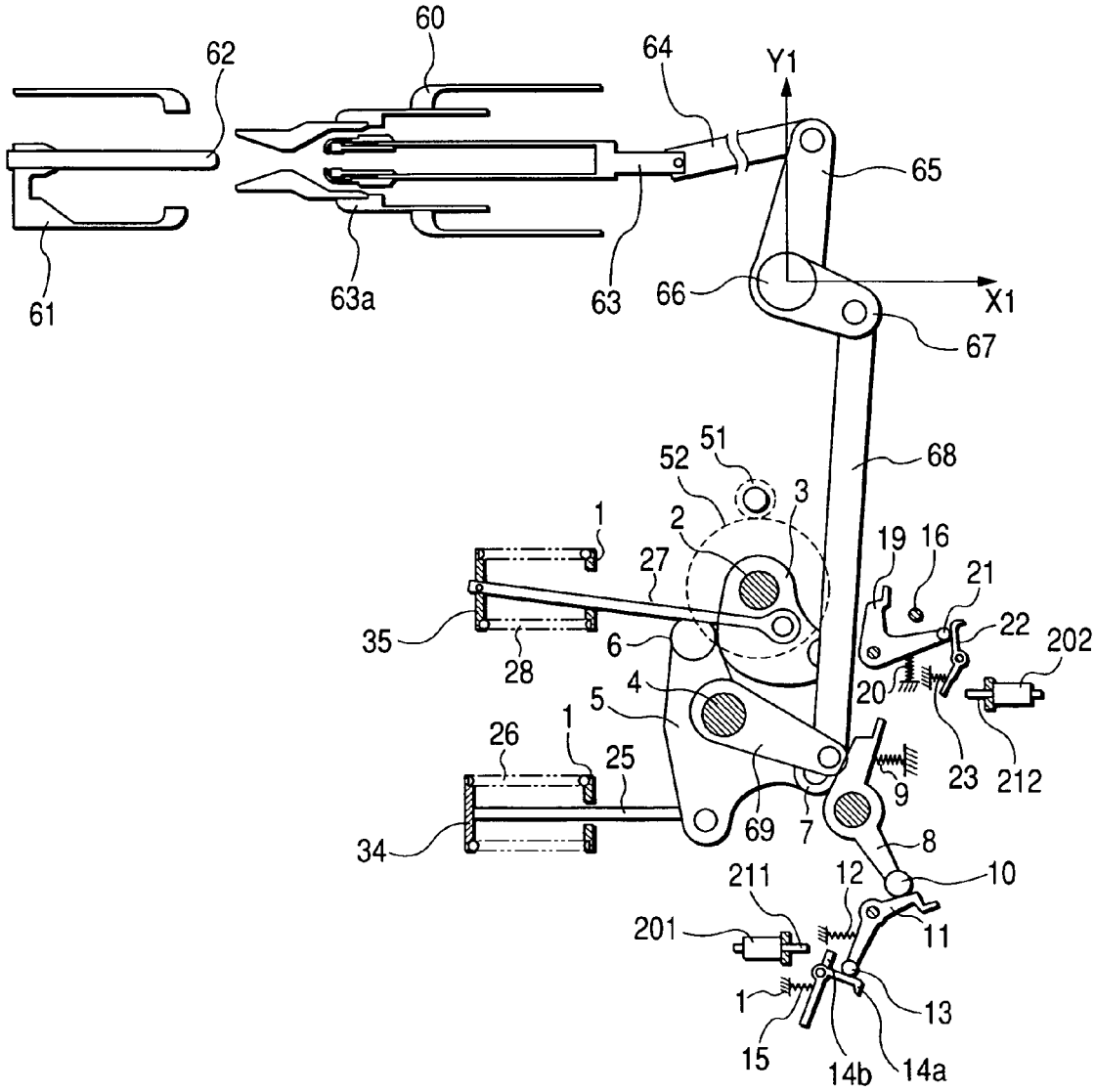
FIG. 3 also illustrates an operation of the gas circuit breaker shown in FIG. 1.
Figure 4:
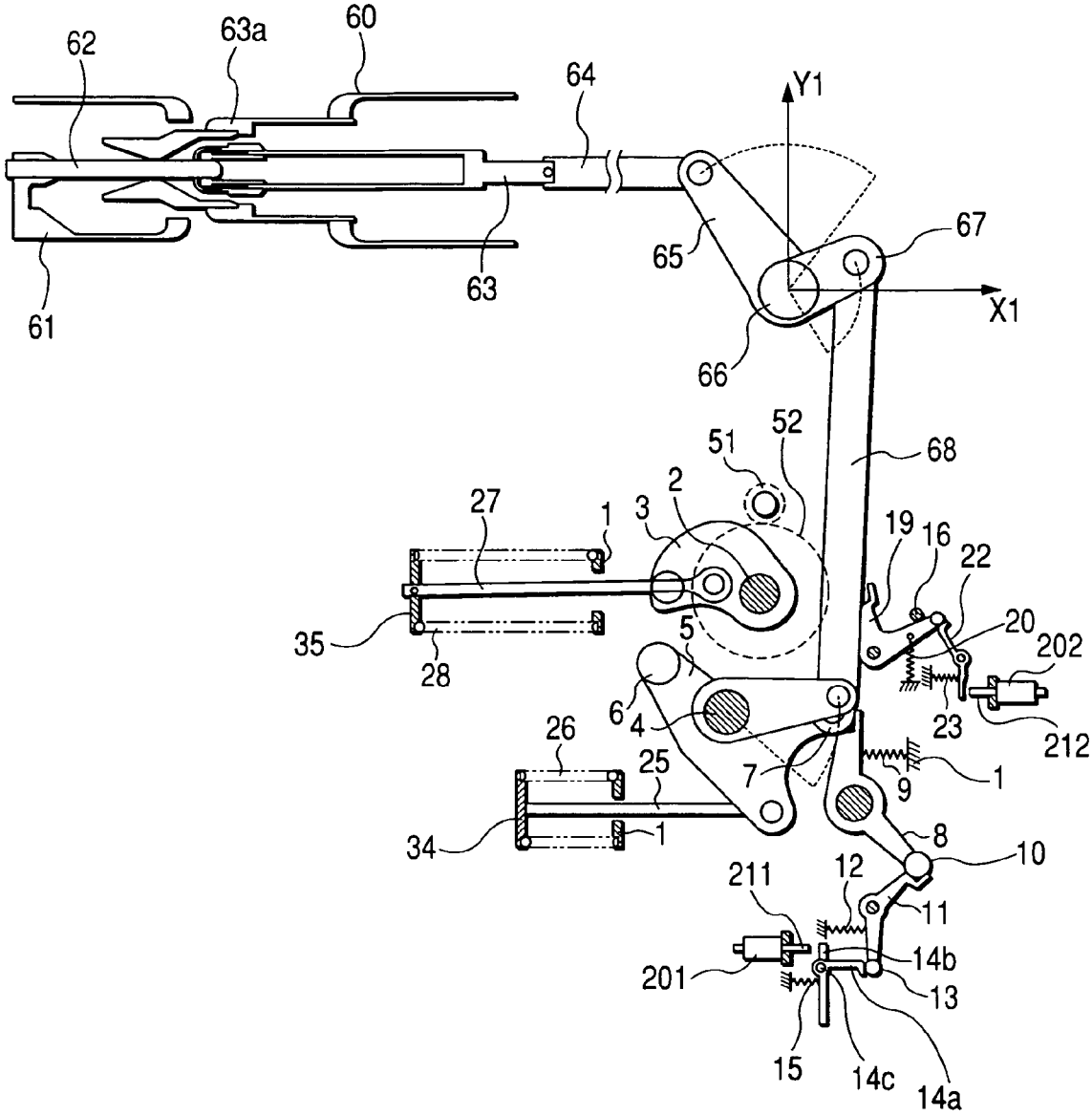
FIG. 4 also illustrates an operation of the gas circuit breaker shown in FIG. 1.
Figure 5:
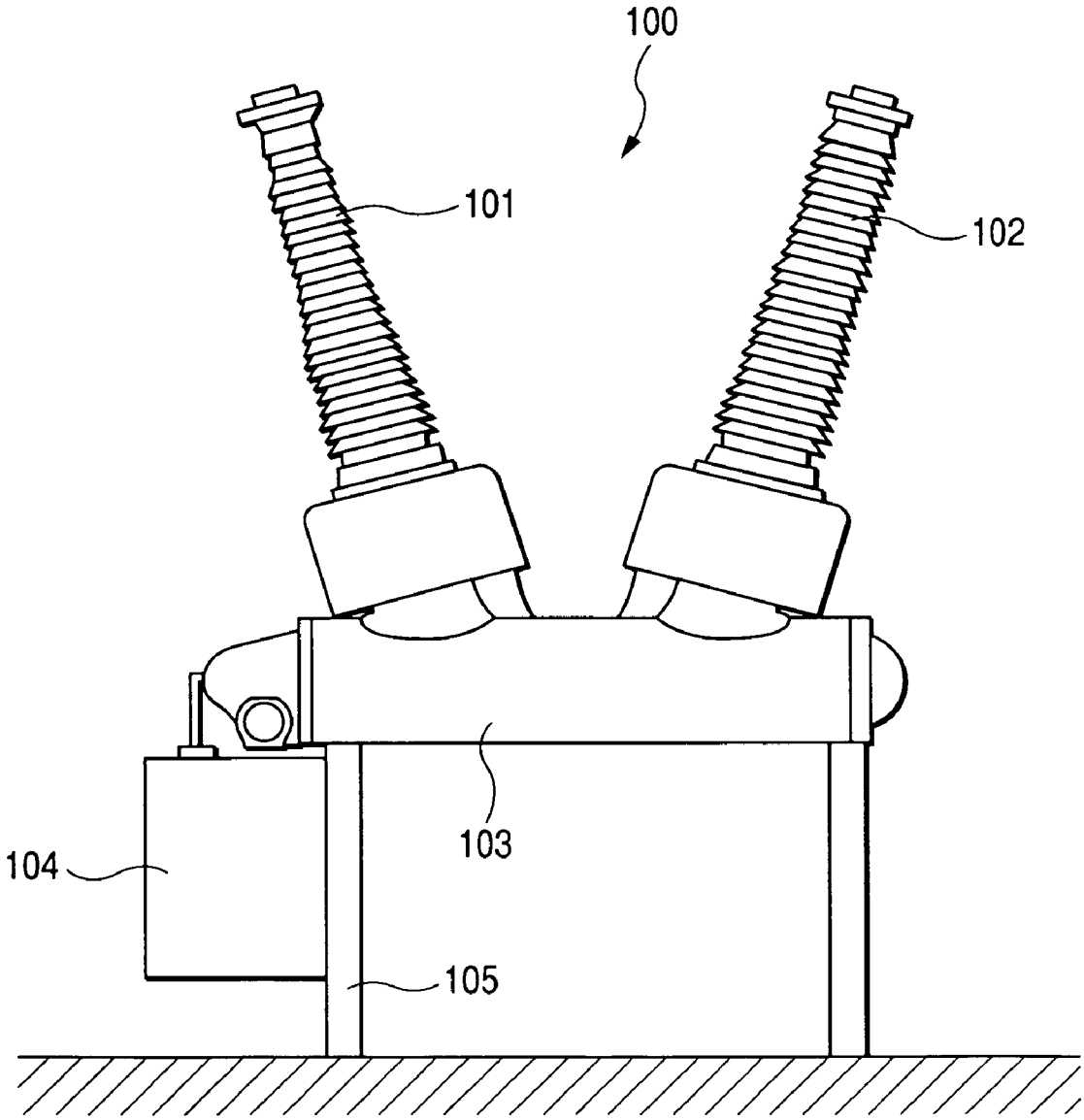
FIG. 5 is a front view of an embodiment of a gas circuit breaker for electric power according to the present invention.

FIGS. 1 to 4 schematically shows an operation unit 400, an interrupter 405, and a link mechanism 406 that interconnects the operation unit 400 and interrupter 405, which are all included in the operation box 104 shown in FIG. 5. FIGS. 1 to 4 sequentially show how the closing and opening operations of the contact in the interrupter 405 proceed. In FIG. 1, a movable contact 63 is in contact with a fixed contact 62 in the interrupter 405. In FIG. 2, the opening operation has been completed. FIG. 3 shows an intermediate state in which the open state is returning to the closed state. In FIG. 4, the closing operation has been completed; a closing spring 28 is released. After the state in FIG. 4, the closing spring 28 is compressed to return to the state in FIG. 1.

In FIG. 1, one end of the fixed contact 62 in the interrupter 405 is fixed to and supported by a tubular conductor 61 on the fixed side, and the other end is in contact with the movable contact 63. One end of the movable contact 63 that is brought into contact with the fixed contact 62 is tubular; when the movable contact moves in the axial direction, the fixed contact fits into the interior of the tube. The fixed conductor 61 on the fixed side, which holds the fixed contact 62, is fixed to and supported by the ground container through an insulated tube (not shown). The fixed contact 62 and fixed conductor 61 constitute a fixed member.

The end opposite to the contact end of the movable contact 63, which is brought into contact with the fixed contact 62, is connected to a rod-like insulator 64. A tubular cylinder 63*a* is disposed on the outer circumference of the movable contact 63. A tubular conductor 60 is disposed on the moving side in contact with the outer circumference of the cylinder 63*a*. The conductor 60 on the moving side is fixed to and supported by the ground container through an insulated tube (not shown).

The link mechanism 406 has a rotational shaft 66, which is rotatably supported by the ground container (not shown). One ends of a second lever 65 and first lever 67 fit to the rotational shaft 66. The angle formed by the first lever 67 and second lever 65 is fixed to θ. The other end of the first lever 67 is connected to a link 68, which is a long shaft provided in the operation unit 400, through a pin 67*a*. The other end of the second lever 65 is connected to the end of the insulator 64, which is opposite to the end to which the movable contact 63 is connected, through a pin 65*a*. The bottom end of the link 68 is connected to a third lever 69 provided in the operation unit 400.

The operation unit 400 has an opening operation section 403 which includes a main shaft 4 and opening spring 26, a closing operation section 404 which includes a cam shaft 2 and closing spring 28, a closing control mechanism 402 for holding and releasing the driving force of the closing spring 28, and an opening control mechanism 401 for holding and releasing the driving force of the opening spring 26.

Attached to the main shaft 4 of the opening operation section 403 are the middle part of a Y-shaped main lever and one end of the third lever 69. Rollers 6 and 7 are attached to two ends of the Y shape of the main lever 5. One end of an opening spring link 25 is rotatably attached to the remaining end of the main lever 5 through a pin 25*a*. A flange 34 is attached to the other end of the opening spring link 25 to retain the opening spring 26 disposed on the outer circumference of the opening spring link 25. The end opposite to the end retained by the flange 34 of the opening spring 26 is retained by a case 1.

The closing operation section 404 is structured in the same way as the opening operation section 403. That is, a large gear 52 is attached to the cam shaft 2; one end of a closing spring link 27 is rotatably attached to the middle part of the large gear 52. A spring retainer 35 is attached to the other end of the closing spring link 27 to retain the other end of the closing spring 28. The closing spring 28 is disposed on the outer circumference of the closing spring link 27. The opposite end of the spring retainer 35 is held by the case 1. Attached to the cam shaft 2 is a cam 3, the outer circumference of which is smoothly curved into an arc shape. A roller 18 is attached near a portion having the maximum radius of the cam 3. A small gear 51 engages the large gear 52; a driving force is transmitted to the small gear 51 from an electric motor (not shown).

Adjacent to the opening operation section 403, the opening operation mechanism 401 is disposed. In the opening operation mechanism 401, a second breaking latch 8 is rotatably attached at the middle part to an shaft 8*a* fixed to the case 1; an engaging part 8*b* formed at one end of the second breaking latch engages the roller 7 provided at one end of the Y-shaped main lever 5. A roller 10 is attached to the other end of the second breaking latch 8. The second breaking latch 8 is bent at the part attached to the shaft 8*a*. One end of a reset spring 9 for returning the second breaking latch 8 to the original state is attached to the middle part between the shaft 8*a* of the second breaking latch 8 and the engaging part 8*b*. The other end of the reset spring 9 is fixed to the case 1.

A breaking latch 11 is engageably disposed to the roller 10. The breaking latch 11 is rotatably attached at the middle part to an shaft 11*a* supported by the case 1. The breaking latch 11 is bent at the part attached to the shaft 11*a*. A roller 13 is attached to the end opposite to an engaging part 11*b* at which the breaking latch 11 engages the roller 10. An end of a breaking trigger 14*a* formed into an L shape touches the roller 13, the end being curved. A reset spring 12, one end of which is fixed to the case 1, is attached to the middle part between the shaft 11*a* of the breaking latch 11 and the roller 13.

The breaking trigger 14*a* is attached at the corner of the L shape to an shaft 14*c*. A rod-like member 14*b* extending upward is also attached to the shaft 14*c*. A plunger 211 of a breaking solenoid 201 is attached to the breaking trigger 14*b* in such a way that the plunger can touch the member 14*b*. A reset spring 15, one end of which is fixed to the case 1, is attached to the other side of the L shape.

The closing control mechanism 402 has a closing latch 19 that can engage the roller 18 attached to the cam 3. The closing latch 19 is approximately V-shaped; the bent part is rotatably attached to an shaft 19*a*. At one end of the V shape of the closing latch 19, a latching part 19*b* is formed which engages the roller 18 of the cam 3. A roller 21 is attached to the other end of the V shape of the closing latch 19.

A closing trigger 22 is disposed in such a way that one end can touch the roller 21. The closing trigger 22 has a bent form; the bent part is rotatably attached to a rotational shaft 22*a*. The rotational shaft 22*a* is supported by the case 1. A reset spring 20, one end of which is fixed to the case 1, is attached between the shaft 19*a* of the closing latch 19 and the roller 21. A closing trigger 22*b* is formed at the end opposite to the end at which the closing trigger 22 touches the roller 21. A plunger 212 of a closing solenoid 202 is disposed in such a way that it can touch the closing trigger 22*b*.

In the gas circuit breaker structured as described above in this embodiment, the reset springs 9, 12, and 15 respectively attached to the second breaking latch 8, breaking latch 11, and breaking trigger 14*a* are compressed while the closed state is held, as shown in FIG. 1. Accordingly, the spring forces of the reset springs 9, 12, and 15 always act on the second breaking latch 8, breaking latch 11, and breaking trigger 14*a*. When the main shaft 4 rotates, the opening spring link 25 moves horizontally. When the spring force of the opening spring 26 disposed in the opening operation section 403 is released, the electric power is shut down. When the spring force of the closing spring 28 in the closing operation section 404 is released, electric power is supplied. The opening spring 26 is compressed when the closing spring 28 is released. The closing spring 28 is compressed by the electric motor, a gear train, and the gears 51 and 52. Force is not applied to the roller 6 disposed at one end of the main lever 5 in the closed state, but a load is transmitted from the outer circumference of the cam 3 to the roller when closing begins.

Operations of the gas circuit breaker 100 structured as above will be described with reference to FIGS. 1 to 4. First, operation for shifting from the closed state shown in FIG. 1 to the open state will be described. When an open command is input in the closed state, the gas circuit breaker 100 starts the opening operation. The breaking solenoid 201 in the opening control mechanism 401 is energized, causing the plunger 211 of the breaking solenoid 201 to extrude and then pressing the trigger lever 14*b*. When being pressed by the plunger 211, the trigger lever 14*b* rotates clockwise. The engagement between the breaking trigger 14 and the breaking latch 11 is then released.

After the disengagement from the breaking trigger 14*a*, the breaking latch 11 can now rotate freely. Since the roller 10 of the second breaking latch 8 is pressing the breaking latch 11, the breaking latch 11 rotates clockwise around the shaft 8*a*. The second breaking latch 8 loses the support by the latching part 11*b* of the breaking latch 11 which has restricted the rotation, and then rotates clockwise due to the pressing force applied by the roller 7 of the main lever 5. As a result, the second breaking latch 8 is disengaged from the main lever 5.

After the disengagement of the breaking latch 8 from the main lever 5, the main lever 5 can now rotate freely. Since the constraint to the opening spring 26 which is wound around the link 25 and placed in a compressed state is removed, the opening spring 26 is released, causing the main lever 5 to rotate clockwise. The third lever 69 also rotates clockwise through the main shaft 4. The rotation of the main lever 5 causes the link 68 connected to the third lever 69 to move downward, rotating the first lever 67 clockwise. The rotational shaft 66 and second lever 65 also rotate clockwise together with the first lever 67. Due to the rotation of the second lever 65, the insulator 64 connected to the second lever 65 and the movable contact 63 move horizontally to the right. Accordingly, the movable contact 63 is detached from the fixed contact 62. When the opening spring 26 is completely released, the opening operation terminates. Then, the roller 6 at an end of the main lever 5 approximately touches the outer circumference of the cam 3 and stops (see FIG. 2).

Operation for the interrupter 405 to shift from the open state in FIG. 2 to the closed state in FIG. 4 will be described below. When a close command is input into the gas circuit breaker 100 in the open state in FIG. 2, the closing solenoid 202 is energized, causing the plunger 212 of the closing solenoid 202 to extrude to the left and thereby pressing the closing trigger 22*b*. The trigger lever 22, which is combined with the closing trigger 22*b*, rotates clockwise, disengaging the trigger lever 22 from the closing latch 19. The closing latch 19 rotates clockwise due to the pressing force applied by the roller 18 attached to the cam 3, causing the closing latch 19 to disengage from the cam 3. The cam 3 loses the support by the latching part 19*b* of the closing latch 19 and thereby rotates freely. Since the restraint to the cam 3 is removed, the spring force of the closing spring 28 is released. As a result, the closing spring link 27 moves to the left. As the closing spring link 27 moves, the cam shaft 2 and large gear 52 rotate clockwise.

Due to the rotation of the cam shaft 2, the cam 3 also rotates clockwise. As shown in FIG. 3, the outer circumference of the cam 3 touches the roller 6 of the main lever 5, causing the main lever 5 to rotate counterclockwise. When the closing operation further proceeds from the state in FIG. 3 and the cam 3 rotates counterclockwise approximately half a turn, the outer circumference of the cam 3 touches the roller 6 of the main lever 5 at the portion at which the radius of curvature on the cam 3 is maximum. At this time, the opening spring link 25 connected to the main lever 5 compresses the opening spring 26 approximately to the original position.

In this closing operation, the main lever 5 rotates and thereby the third lever 69 rotates counterclockwise through the main shaft 4, moving the link 68 upward. The first lever 67 connected to the link 68, the rotational shaft 66, and the second lever 65 rotate counterclockwise. Accordingly, the insulator 64 connected to the second lever 65 and the movable contact 63 moves to the left. When the closing spring 28 is completely released, the movable contact 63 touches the fixed contact 62, making contact (see FIG. 4). Upon the completion of the closing operation, in the operation unit 400, the reset springs 9, 12, and 15 restore the levers 8, 11, and 14*a* in the opening control mechanism 401 to their original positions, thereby retaining the spring force of the opening spring 26.

When the closing operation is completed, the small gear 51 is driven by the electric motor and gear train (not shown) so as to rotate the large gear 52 clockwise. The clockwise rotation of the large gear 52 causes the closing spring 27 to move to the right and the closing spring 28 to be compressed. When the large gear 52 rotates approximately half a turn, the electric motor stops according to a command from a limit switch (not shown). At this time, the closing spring 28 attempts to release the spring force. Since the roller 18 of the cam 3 engages the closing lever 19 and the closing lever 19 engages the closing trigger 22, as described above, however, the rotation of the cam 3 is prevented. Therefore, as shown in FIG. 1, the spring force of the closing spring 28 is retained, returning the interrupter 405 to the state in which the closed state is held and also returning the opening spring 26 and closing spring 28 to their initial states in which they are compressed.

In the link mechanism 406 connected to the interrupter 405 in this embodiment, a distance $\rho_2$ between the pin 65*a* of the second lever 65 and the rotational shaft 66 is about twice a distance $\rho_1$ between the pin 67*a* of the first lever 67 and the rotational shaft 66. This arrangement increases the stroke of the movable contact 63 to approximately twice the stroke of the opening spring 26, and also allows the movable contact 63 to be driven by a spring force about half the spring force of the opening spring 26. With a driving source using a helical spring, a longer spring stroke increases the necessary spring length, resulting in a large operation unit. To address this problem, this embodiment uses a link mechanism to increase the stroke of the movable contact so that the operation unit is made compact.

Next, the operation of the link mechanism 406 in the above gas circuit breaker 100 will be described in detail with reference to FIG. 6. When the gas circuit breaker 100 is opened and closed, the third lever 69 connected to the main shaft 4 in the operation unit 400 rotates and moves the link 68, which links the operation unit 400 to the interrupter 405, up and down. The up and down motion of the link 68 rotates the first lever 67 and rotational shaft 66 together. Then, the second lever 65 rotates by the same rotational angle as the rotation of the first lever, and the movable contact 63 moves horizontally.

Figure 6:
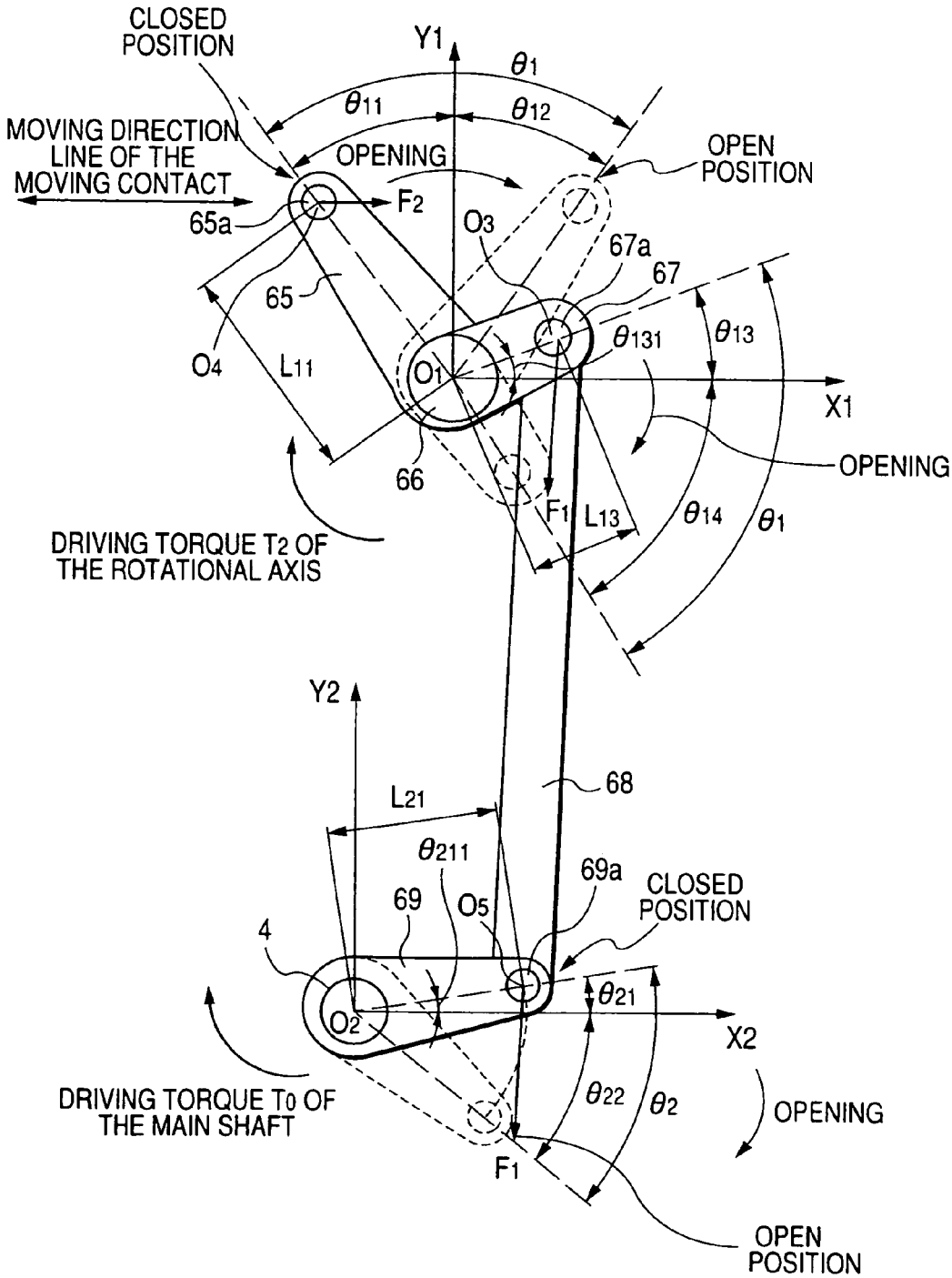
FIG. 6 illustrates the operations of levers of the gas circuit breaker shown in FIG. 1.

With the link mechanism 406 shown in this embodiment, coordinates are set as shown in FIG. 6. The positions of the first lever 67, second lever 65, and third lever 69 in the link mechanism 406 are indicated by solid lines when the interrupter 405 is in the closed state and by dotted lines when the interrupter 405 is in the open state. When the interrupter 405 is opened, the main shaft 4 rotates clockwise by an angle of $\theta_2$, moving the link 68 down. The rotational shaft 66 then rotates clockwise by $\theta_1$ from the closed position indicated by the solid lines to the open position indicated by the dotted lines. When the interrupter 405 is closed, the main shaft 4 similarly rotates counterclockwise by an angle of $\theta_2$, moving the link 68 up. The rotational shaft 66 then rotates counterclockwise by an angle of $\theta_1$ from the open position.

A two-dimensional plane is defined for the link mechanism 406; the motion directions of the movable contact 63 are direction on the X shaft, and the directions orthogonal to the X shaft are directions on the Y shaft. A local coordinate system is also set, in which the center of the rotational shaft 66 is the origin, and an X1 shaft parallel to the X1 shaft and a Y1 shaft parallel to the Y shaft are set. Another local coordinate system is also set, in which the center of the main shaft 4 in the operation unit 400 is the origin, an X2 shaft parallel to the X shaft and a Y2 shaft parallel to the Y shaft are set.

Since the first lever 67 and second lever 65 in the link mechanism 406 fit to the rotational shaft 66 as described above, the rotational operation angles of the first lever 67 and second lever 65 are the same; the range of the rotational operation angle from closed to open is $\theta_1$. For the third lever 69 in the operation unit 400, the range of the rotational operation angle from closed to open is $\theta_2$. The rotational operation angle range $\theta_2$ of the third lever 69 has the following relationship with the rotational operation angle range $\theta_1$ of the first lever 67 and second lever 65: $\theta_1 > \theta_2$.

The rotational operation angle range $\theta_1$ of the first lever 67 is divided by the X1 shaft into two parts. The rotation range from the closed position to the X1 shaft is set to $\theta_{13}$, and the rotation range from the X1 shaft to the open position is set to $\theta_{14}$. Similarly, the rotational operation angle range $\theta_1$ of the second lever 65 is divided by the Y1 shaft into two parts. The rotation range from the closed position to the Y1 shaft is set to $\theta_{11}$, and the rotation range from the Y1 shaft to the open position is set to $\theta_{12}$. The rotational operation angle range $\theta_2$ of the third lever 69 in the operation unit 405 is divided by the X2 shaft into two parts. The rotation range from the closed position to the X2 shaft is set to $\theta_{21}$, and the rotation range from the X2 shaft to the open position is set to $\theta_{22}$.

In this embodiment, to make the rotational operation angle $\theta_2$ of the third lever 69 symmetrical with respect to the Y2 shaft, a first part and second part of the stroke of the opening spring 26 are set to lengths up to the Y2 shaft, by which the rotational operation angle $\theta_2$ of the third lever 69 is approximately halved. This arrangement lessens the vertical oscillation of the opening spring 26 that is caused when the opening spring 26 is released and compressed, thereby reducing the driving loss.

Figure 7:
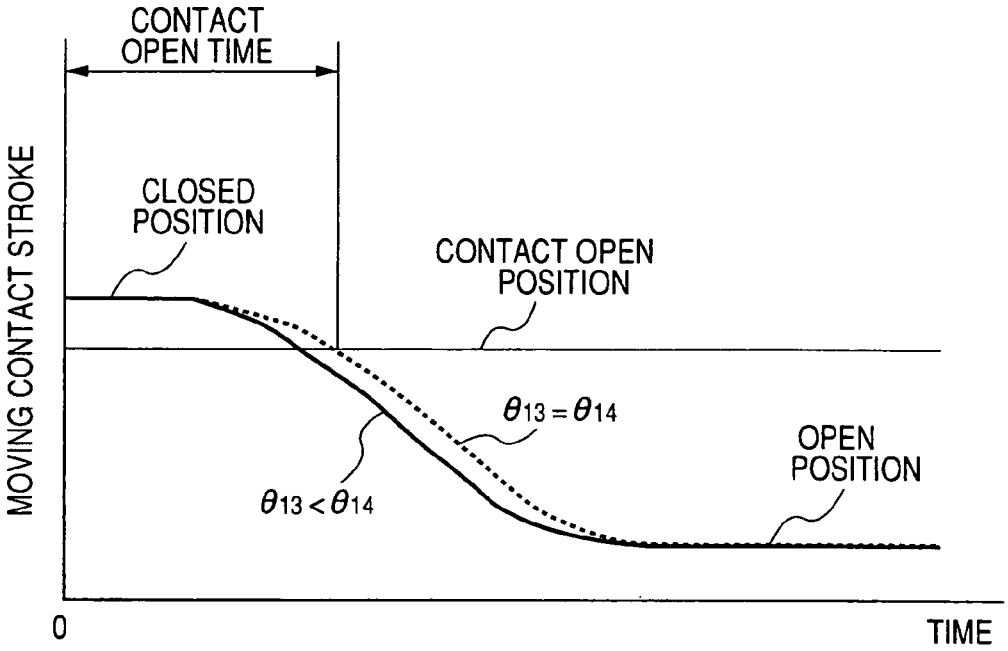
FIG. 7 is a graph indicating the operation of the gas circuit breaker shown in FIG. 1.

FIG. 7 shows how the stroke of the movable contact 63 in the interrupter 405 changes with time. When time is zero, an open command is input. Contact open time of the gas circuit breaker 100 is measured from when the interrupter 405 starts to change from the closed state until the movable contact 63 moves by a prescribed distance. As indicated by FIG. 7, when the rotational operation angle $\theta_{13}$ of the first lever is smaller than $\theta_{14}$, the contact open time can be reduced as compared with a case in which $\theta_{13}$ equals $\theta_{14}$. The reason is described below. In FIG. 6, the driving force $F_2$ of the movable contact 63 at the start of opening is obtained from the distance from the rotational center $O_1$ of the first lever 67 to the center $O_3$ of the pin 67*a*, the distance from the $O_1$ of the second lever 65 to the $O_4$ of the pin 65*a*, and the distance from the $O_2$ of the third lever 69 to the $O_5$ of the pin 69*a*, as well as toque $T_0$ of the main shaft 4 in the operation unit 400, as indicated by equation (1).

[Equation 1]

$$F_2 = \frac{L_{13}\cos\theta_{13}}{L_{11}L_{21}\cos\theta_{11}\cos\theta_{21}}T_0 \quad (1)$$

At the start of opening, the link 68 is approximately vertical. Accordingly, angles $\theta_{131}$ and $\theta_{211}$, which are formed, with respect to the X shaft, by two normals (moment arms) extending from the rotational center $O_2$ of the main shaft 4 and the center $O_1$ of the rotating shaft 66 in the direction in which the driving force $F_1$ of the link 68 acts, are very small, so $\theta_{211}$ and $\theta_{131}$ can be approximated to $\theta_{21}$ and $\theta_{13}$, respectively.

If the angle $\theta_{13}$ formed by the first lever 67 and X1 shaft is changed to zero in equation (1), the driving force $F_2$ of the movable contact 63 at the start of opening is maximized. This is true when the closed position of the first lever 67 is on the X1 shaft. That is, to minimize the contact open time, it suffices to place the closed position of the first lever 67 horizontally.

Figure 8:
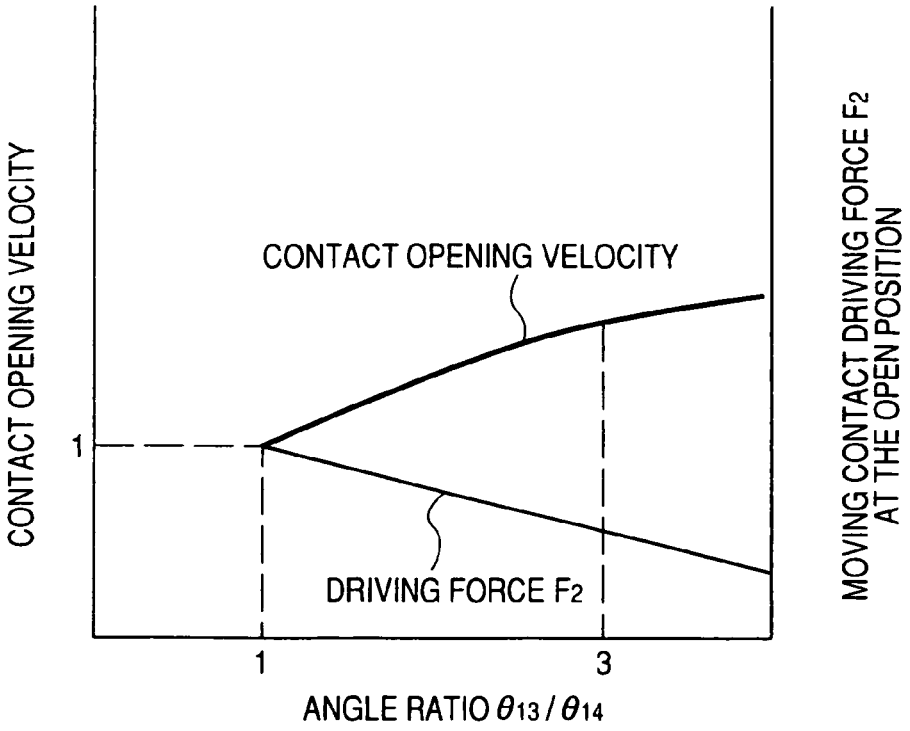
FIG. 8 is another graph indicating the operation of the gas circuit breaker shown in FIG. 1.

In FIG. 6, the ratio of the two rotational angles $\theta_{13}$ and $\theta_{14}$ of the first lever 67 ($\theta_{14}$ to $\theta_{13}$) is about one-third. The driving force $F_2$ for driving the movable contact 63 is lowered at a position where opening terminates, so this ratio is set to suppress the reduction. FIG. 8 shows how the driving force $F_2$ changes as the rotational angle ratio $\theta_{14}/\theta_{13}$ changes. If the rotational angle $\theta_{13}$ of the first lever 67 is small and the ratio $\theta_{14}/\theta_{13}$ is large, the contact opening velocity increases, but $\theta_{14}$ increases at the open position and the driving force $F_2$ is reduced as compared when $\theta_{14}$ equals $\theta_{13}$.

In the gas circuit breaker 100, a pressure equal to or greater than a prescribed value acts on the movable contact 63 and also acts on the operation unit 400 as a force resisting to the load. It is known that the peak of the pressure appears in a second part of the opening stroke. When high current is shut down, there is a large pressure rise; if the driving force $F_2$ of the movable contact 63 is significantly reduced at the open position, sufficient current shutdown performance may not be obtained. Accordingly, the rotational angle ratio $\theta_{14}/\theta_{13}$ is increased to at most about three times, thereby increasing the contact opening velocity and suppressing the driving force $F_2$ at the open position as much as possible.

When the stroke of the second lever 65, which swings by the same stroke as the movable contact 63 is divided into a first part and second part by the Y1 shaft, the rotational angles of the first part and second part are almost the same. This eliminates the need to use the swing link and other components other than the insulator. Therefore, variations in the force that acts on the conductor 60 on the moving side which guides the movable contact 63 can be suppressed.

Figure 9:
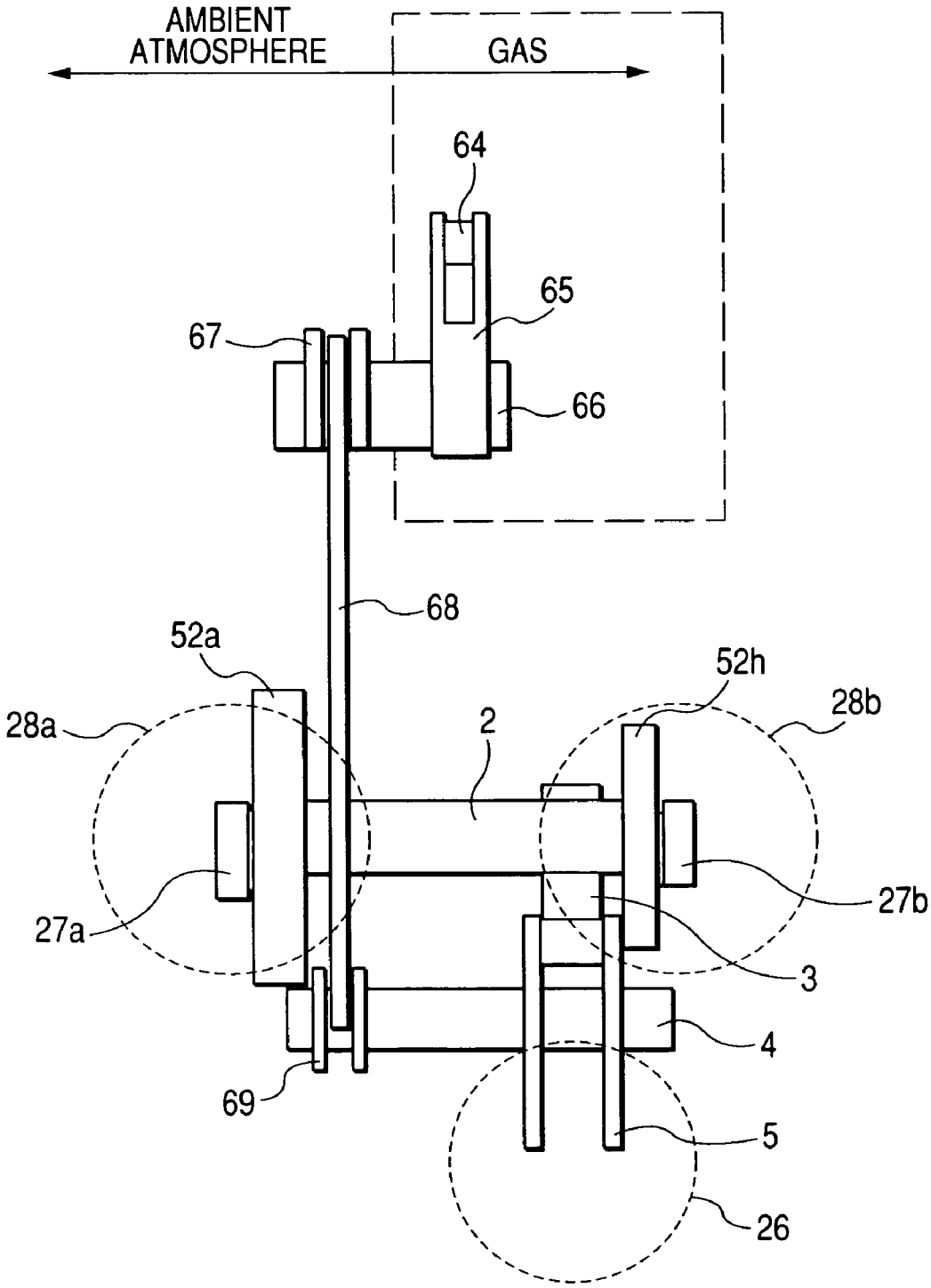
FIG. 9 is a side view of the gas circuit breaker shown in FIG. 1.

Gas seal in the gas circuit breaker 100 will now be described in detail with reference to FIG. 9. FIG. 9 is a cross-sectional view of a side of the gas circuit breaker 100. Operation planes of the first lever 67 and second lever 65 are disposed in parallel in the depth direction (horizontal direction in FIG. 9). At the middle portion between the first lever 67 and second lever 65 in the axial direction, the circumference of the rotational shaft 66 is shielded by a shielding member (not shown). An end of the second lever 65 is formed like a fork; an insulator 64 is disposed between fork prongs.

The dash-dot lines in FIG. 9 indicate an accommodating member which accommodates in an insulative gas atmosphere the far-end side (the right side in the figure) of the rotational shaft 66, the second lever 65, the insulator 64, and parts disposed beyond the insulator 64 and toward the interrupter 405. The shielding member is retained in the accommodating member. The near-end side (the left side in the figure) of the rotational shaft 66, the first lever 67, and parts disposed beyond the first lever and toward the operation unit 400 are in the ambient atmosphere. Driving force is transmitted from the operation unit 400 to the rotational shaft 66, causing a bend and twist. To prevent this, a bearing apparatus is disposed properly so as to lessen the amount of eccentricity during operation. Accordingly, it is only necessary to seal the rotating shaft 66 which rotates; members that are directly driven do not need to be sealed. The resulting seal is firm, and generally used O-rings and the like can be used, facilitating the sealing process.

In the above embodiment, the fitting between the first lever 67 and rotational shaft 66 and the fitting between the third lever 69 and main shaft 4 are implemented by spline coupling and coupling of an angular shaft and angular hole, so these levers can be externally attached and detached with ease. In addition, the levers can be replaced easily with levers for which $\theta_{13}$ and other angle settings differ according to the contact opening velocity, facilitating the adjustment of the contact opening velocity.

In a gas circuit breaker, according to this embodiment, which has an operation unit using helical springs as a driving source, the operation stroke positions of a first lever are asymmetrical with respect to a horizontal shaft, increasing the driving force of a movable contact. In addition, the gas circuit breaker can be made compact by reducing the number of parts in an interrupter, which reduces the contact open time in the gas circuit breaker and thereby achieving high-speed breaking operation.

What is claimed is:

1. A gas circuit breaker comprising:

an interrupter for turning on and off electric power by opening and closing a contact between a fixed contact member and a movable contact member;

a link mechanism comprising a first lever, a second lever rotatably linked to the movable contact member, and a rotational shaft for attaching the first and second levers, the first and second levers rotating together around the rotational shaft;

an operation unit which comprises a third lever, a main shaft for rotating the third lever, and an opening spring attached to the main shaft through a main lever to rotate the main shaft and generate a driving force for driving the movable contact member; and a link for interconnecting the third lever of the operation unit and the first lever of the link mechanism: wherein an operation angle of the second lever with respect to a direction perpendicular to the motion direction of the movable contact member is almost the same between when the contact is open and when the contact is closed; and a first operation angle of the first lever with respect to a direction parallel to the motion direction of the movable contact member when the contact is open is larger than a second operation angle thereof when the contact is closed.

2. The gas circuit breaker according to claim 1, wherein rotational operation angles of the first lever and second lever is larger than a rotational operation angle of the third lever.

3. The gas circuit breaker according to claim 1, wherein when the operation angles of the first lever with respect to a direction parallel to the motion direction of the movable contact member are compared between when the contact is open and when the contact is closed, the ratio of the first operation angle with the contact open to the second operation angle with the contact closed is about 3:1.

4. The gas circuit breaker according to claim 1, wherein the operation unit has helical compression springs as a driving source.

5. The gas circuit breaker according to claim 1, wherein the link has a first pivot rotatably connected to the third lever of the operation unit and a second pivot rotatably connected to the first lever of the link mechanism.

6. The gas circuit breaker according to claim 5, wherein the link has a linear body between the first pivot and the second pivot.

7. A gas circuit breaker comprising:

an interrupter for turning on and off electric power by opening and closing a contact between a fixed contact member and a movable contact member;

a link mechanism comprising a first lever, a second lever rotatably connected to the movable contact member, and a rotational shaft for attaching the first and second levers, the first and second levers rotating together around the rotational shaft, the second lever being rotatable with respect to the movable contact member;

an operation unit which comprises a third lever, a main shaft for rotating the third lever, and an opening spring attached to the main shaft through a main lever to rotate the main shaft; and a link for rotatably interconnecting the third lever of the operation unit and the first lever of the link mechanism;

wherein the opening spring is configured to move the main lever to rotate the main shaft which rotates the third lever to displace the link in order to rotate the first and second levers around the rotational shaft to generate a driving force for driving the movable contact member; and wherein a first operation angle of the first lever with respect to a direction parallel to the motion direction of the movable contact member when the contact is open is larger than a second operation angle thereof when the contact is closed.

8. The gas circuit breaker according to claim 7, wherein an operation angle of the second lever with respect to a direction perpendicular to the motion direction of the movable contact member is almost the same between when the contact is open and when the contact is closed.

9. The gas circuit breaker according to claim 7, wherein the link has a first pivot rotatably connected to the third lever of the operation unit and a second pivot rotatably connected to the first lever of the link mechanism.

10. The gas circuit breaker according to claim 9, wherein the link has a linear body between the first pivot and the second pivot.

11. The gas circuit breaker according to claim 7, wherein rotational operation angles of the first lever and second lever is larger than a rotational operation angle of the third lever.

12. The gas circuit breaker according to claim 7, wherein when the operation angles of the first lever with respect to a direction parallel to the motion direction of the movable contact member are compared between when the contact is open and when the contact is closed, the ratio of the first operation angle with the contact open to the second operation angle with the contact closed is about 3:1.

13. The gas circuit breaker according to claim 7, wherein the opening spring comprises a helical compression spring.

14. A gas circuit breaker comprising:

an interrupter for turning on and off electric power by opening and closing a contact between a fixed contact member and a movable contact member;

a link mechanism comprising a first lever, a second lever rotatably connected to the movable contact member, and a rotational shaft for attaching the first and second levers, the first and second levers rotating together around the rotational shaft, the second lever being rotatable with respect to the movable contact member;

an operation unit which comprises a third lever, a main shaft attached to the third lever for rotating the third lever, and an opening spring attached to a main lever which is attached to the main shaft to rotate the main shaft by movement of the opening spring; and a link for rotatably interconnecting the third lever of the operation unit and the first lever of the link mechanism, the link having a first pivot rotatably connected to the third lever of the operation unit and a second pivot rotatably connected to the first lever of the link mechanism;

wherein movement of the opening spring moves the main lever to rotate the main shaft which rotates the third lever to displace the link via the first pivot in order to rotate via the second pivot the first and second levers around the rotational shaft to generate a driving force for driving the movable contact member to move with respect to the fixed contact member.

15. The gas circuit breaker according to claim 14, wherein a first operation angle of the first lever with respect to a direction parallel to the motion direction of the movable contact member when the contact is open is substantially larger than a second operation angle thereof when the contact is closed.

16. The gas circuit breaker according to claim 14, wherein an operation angle of the second lever with respect to a direction perpendicular to the motion direction of the movable contact member is almost the same between when the contact is open and when the contact is closed.

17. The gas circuit breaker according to claim 14, wherein the link has a linear body between the first pivot and the second pivot.

18. The gas circuit breaker according to claim 14, wherein rotational operation angles of the first lever and second lever is larger than a rotational operation angle of the third lever.

19. The gas circuit breaker according to claim 14, wherein when the operation angles of the first lever with respect to a direction parallel to the motion direction of the movable contact member are compared between when the contact is open and when the contact is closed, the ratio of the first operation angle with the contact open to the second operation angle with the contact closed is about 3:1.

20. The gas circuit breaker according to claim 14, wherein the opening spring comprises a helical compression spring.

* * * * *